US005704710A

United States Patent [19]

Greene et al.

[11] Patent Number: 5,704,710

[45] Date of Patent: Jan. 6, 1998

[54] LIGHTING FIXTURE WITH A SAFETY HOOK

[75] Inventors: Ann Greene, Cranford; Richard Sangiamo, Linden, both of N.J.

[73] Assignee: The Genlyte Group, Incorporated, Seacucus, N.J.

[21] Appl. No.: 608,723

[22] Filed: Feb. 29, 1996

[51] Int. Cl.[6] ..... F21V 21/00

[52] U.S. Cl. ..... 362/374; 362/376; 362/396; 362/453

[58] Field of Search ..... 362/362, 374, 362/375, 396, 457, 376, 363, 453, 454, 455

[56] References Cited

U.S. PATENT DOCUMENTS

| | | | |
|---|---|---|---|
| 2,960,361 | 11/1960 | Boutelle | 362/374 |
| 3,299,265 | 1/1967 | Rackley et al. | 362/374 |
| 3,991,905 | 11/1976 | Nicpon | 362/375 |

FOREIGN PATENT DOCUMENTS

| | | | |
|---|---|---|---|
| 68296 | 8/1969 | Germany | 362/374 |
| 3021850 | 10/1981 | Germany | 362/374 |

*Primary Examiner*—Alan Cariaso

*Attorney, Agent, or Firm*—Kane,Dalsimer,Sullivan, Kurucz, Levy, Eisele and Richard, LLP

[57] ABSTRACT

A lighting fixture with a safety hook allows easier wiring of a lighting fixture, allows easier and accurate alignment and attachment of the fixture's housing and cover during installation and prevents the fixture from dropping down during servicing. A safety hook with two stages or hook elements is installed in the cover of the lighting fixture. An eye flange with a slot is installed in the housing so that the slot can slide over the safety hook in the cover. As the slot is guided over the safety hook, the slot will engage the first stage or hook element which allows the housing to hang from the cover without any assistance from the installer while the necessary wiring connections are made. Then, the slot is guided further onto the safety hook until the slot engages the second stage or hook element which allows the housing and cover to be easily aligned and connected. In addition, if the fixture needs to be serviced, the safety hook prevents the housing from dropping down onto the person servicing the fixture as the housing is removed from the cover.

3 Claims, 4 Drawing Sheets

LIGHTING FIXTURE WITH A SAFETY HOOK

BACKGROUND OF THE INVENTION

1. Field of the Invention

The present invention pertains to a lighting fixture with a safety hook having two stages or hook elements which allow easier wiring of a lighting fixture, allow easier and accurate alignment and attachment of the fixture's housing and cover during installation and prevent the fixture from dropping down during servicing.

2. Description of the Prior Art

Most lighting fixtures, such as fixtures with a housing and a cover, are difficult to wire and install. The housing usually is large and contains other electrical components such as a ballast or may be connected to other fixture components such as a lamp or socket. Thus, the housing usually is very heavy and not easy to handle. For example, when installing such a fixture, an installer or contractor first installs the cover against a ceiling. Then, the installer or contractor somehow holds the large and heavy housing, such as with a shoulder, while attaching the wires in the housing to the supply wires in the ceiling. Next, the installer or contractor attaches the housing to the cover by somehow holding the housing with one hand and tightening the screws connecting the housing and cover with the other hand. Overall, these previous lighting fixture designs are hard to install.

Therefore, in order to alleviate these problems, an objective of the present invention is to provide a lighting fixture with a safety hook which allows a lighting fixture to be easily and quickly installed.

Another objective of the present invention is to provide a lighting fixture with a safety hook where the safety hook allows easier wiring of the fixture.

Another objective of the present invention is to provide a lighting fixture with a safety hook where the safety hook allows easier alignment of a housing of the lighting fixture with a cover of the lighting fixture and allows easy attachment of the housing to the cover.

Another objective of the present invention is to provide a lighting fixture with a safety hook where the safety hook has two stages or hooks that allow for the easier wiring of the fixture and allow for the housing to be easily and safely attached to the cover.

Another objective of the present invention is to provide a lighting fixture with a safety hook where during servicing, the housing will not drop down onto the person servicing the fixture when the housing is removed from the cover.

SUMMARY OF THE INVENTION

The above and other beneficial objectives are obtained in accordance with the present invention by providing a lighting fixture with a safety hook. The safety hook has two stages or hook elements. The first stage or hook element allows a housing of a lighting fixture to hang from a cover of the lighting fixture while an installer or contractor makes the necessary wiring connections. The second stage or hook element allows the installer or contractor to easily align and attach the housing to the cover. If the fixture needs to be serviced, the safety hook prevents the housing from dropping down as the housing is removed from the cover.

DETAILED DESCRIPTION OF THE PREFERRED EMBODIMENTS

The aforementioned figures illustrate a lighting fixture with a safety hook 10 where identical numerals in each figure represent identical elements.

Figure 1:
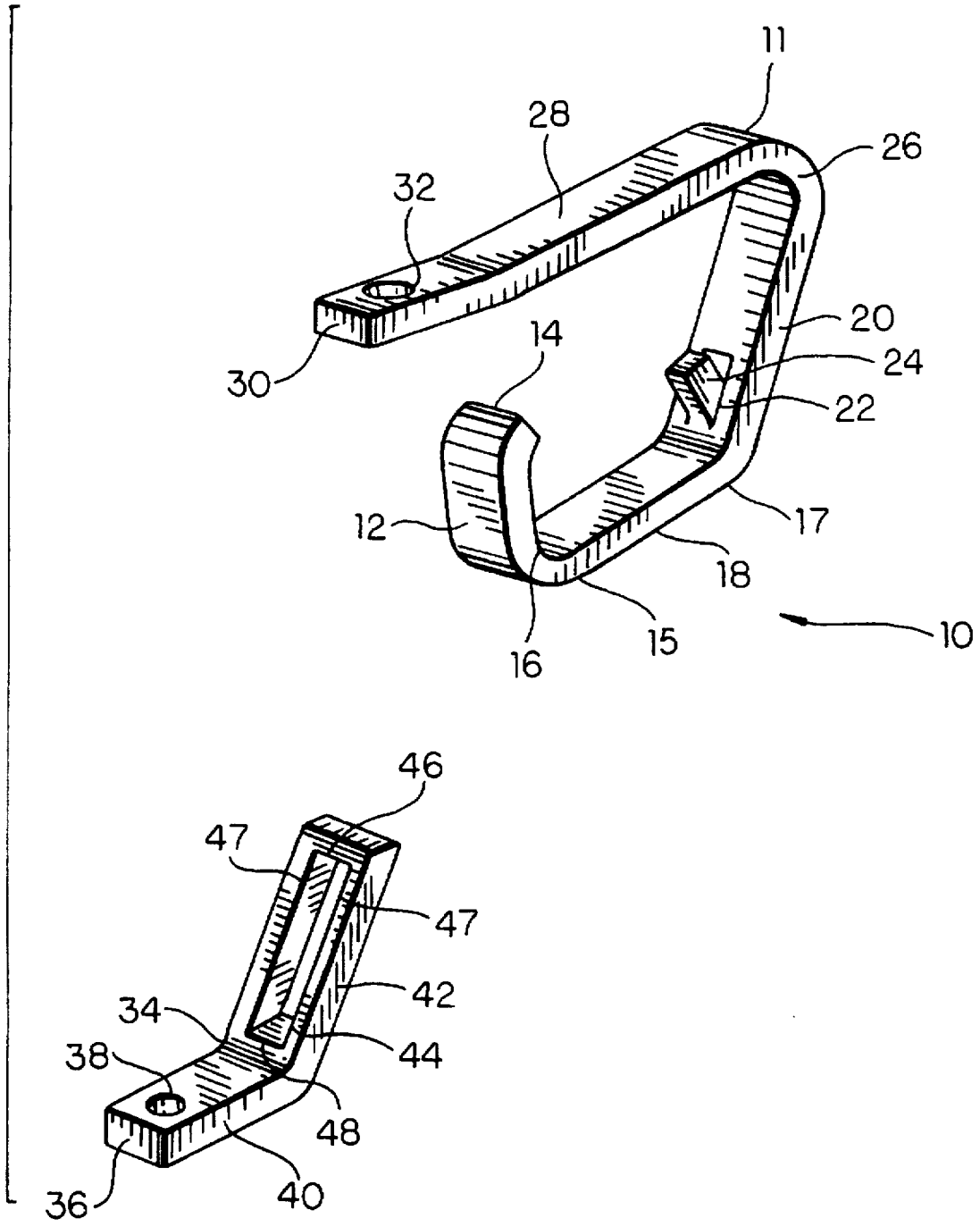
FIG. 1 is an exploded, perspective view of the hook and the eye of a lighting fixture with a safety hook.

A lighting fixture with a safety hook 10 has two main parts, a hook 11 and an eye flange 34 as illustrated in FIG. 1. Hook 11 has two hook elements, first hook element 12 and second hook element 22.

First hook element 12 is on hooked free end 15 of hook 11. First hook element 12 has a free end 14 positioned above and extending down into bottom end 16. Bottom end 16 extends into base member 17.

Second hook element 22 is on base member 17. Bottom end 16 extends into a first sloped portion 18 of base member 17. First sloped portion 18 gradually slopes upward into second sloped portion 20 which has a steeper slope than first sloped portion 18. Second sloped portion 20 has second hook element 22 which is a tab 24 that extends out and away from second sloped portion 20 and extends towards hooked free end 15. Second sloped portion 20 continues into top portion 26 which in turn extends into flat portion 28. Flat portion 28 then extends over and beyond hooked free end 15 to end 30. End 30 has a hole 32.

An eye flange 34 has an slot 44 which is received by hook 11. Flange 34 has a free end 36 with a hole 38. Free end 36 extends to flat portion 40 which then slopes upward into sloping portion 42. Sloping portion 42 contains an elongated slot 44 with a front edge 46, side edges 47 and a rear edge 48. Slot 44 runs along most of sloping portion 42. In addition, sloping portion 42 of eye flange 34 and second sloping portion 20 of hook 11 slope at the same angle.

Figure 2:
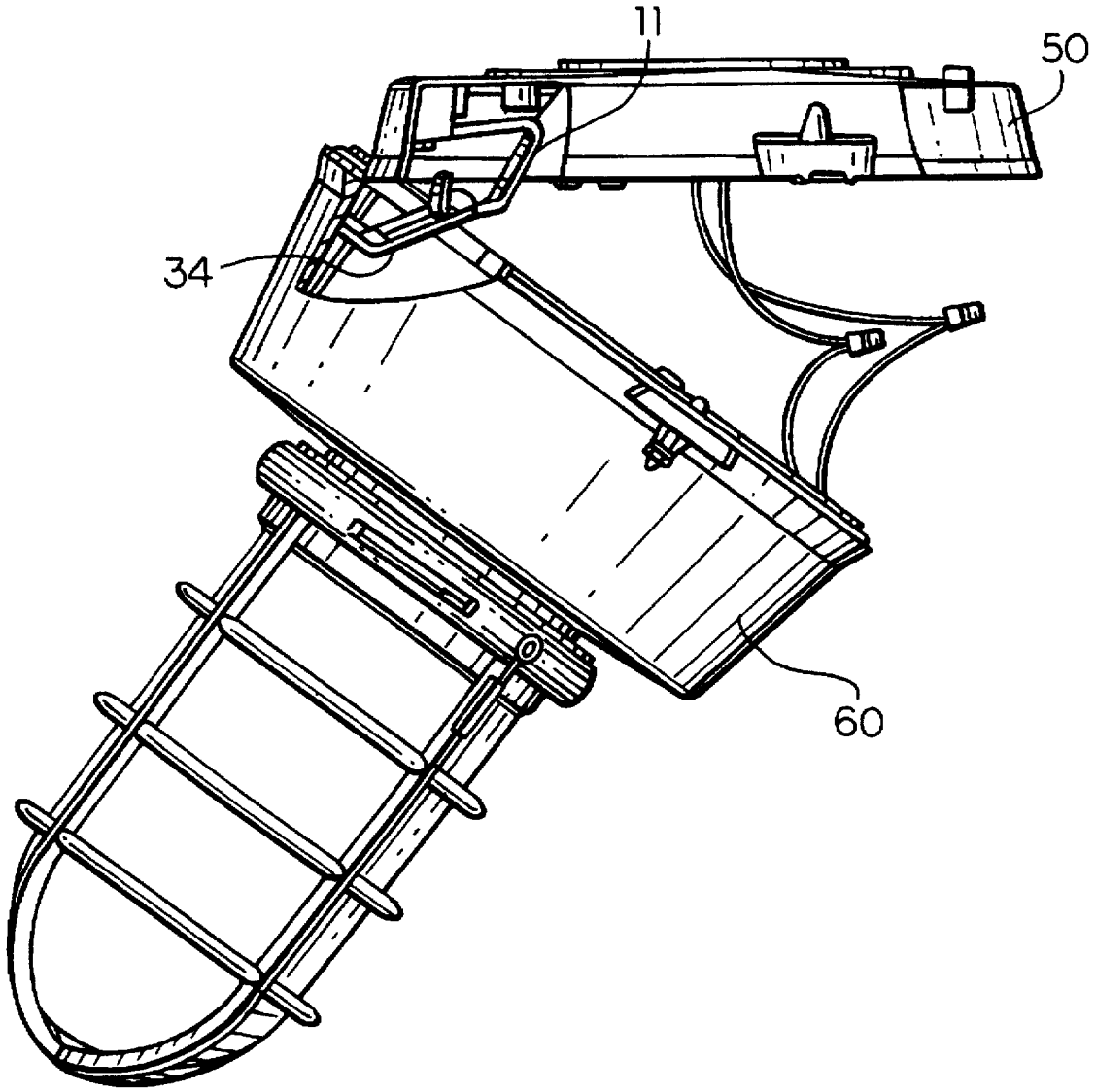
FIG. 2 illustrates a lighting fixture with a safety hook with a cutaway view of the safety hook in its first stage where a housing of the lighting fixture hangs from a cover of the lighting fixture to allow easier wiring of the fixture.
Figure 3:
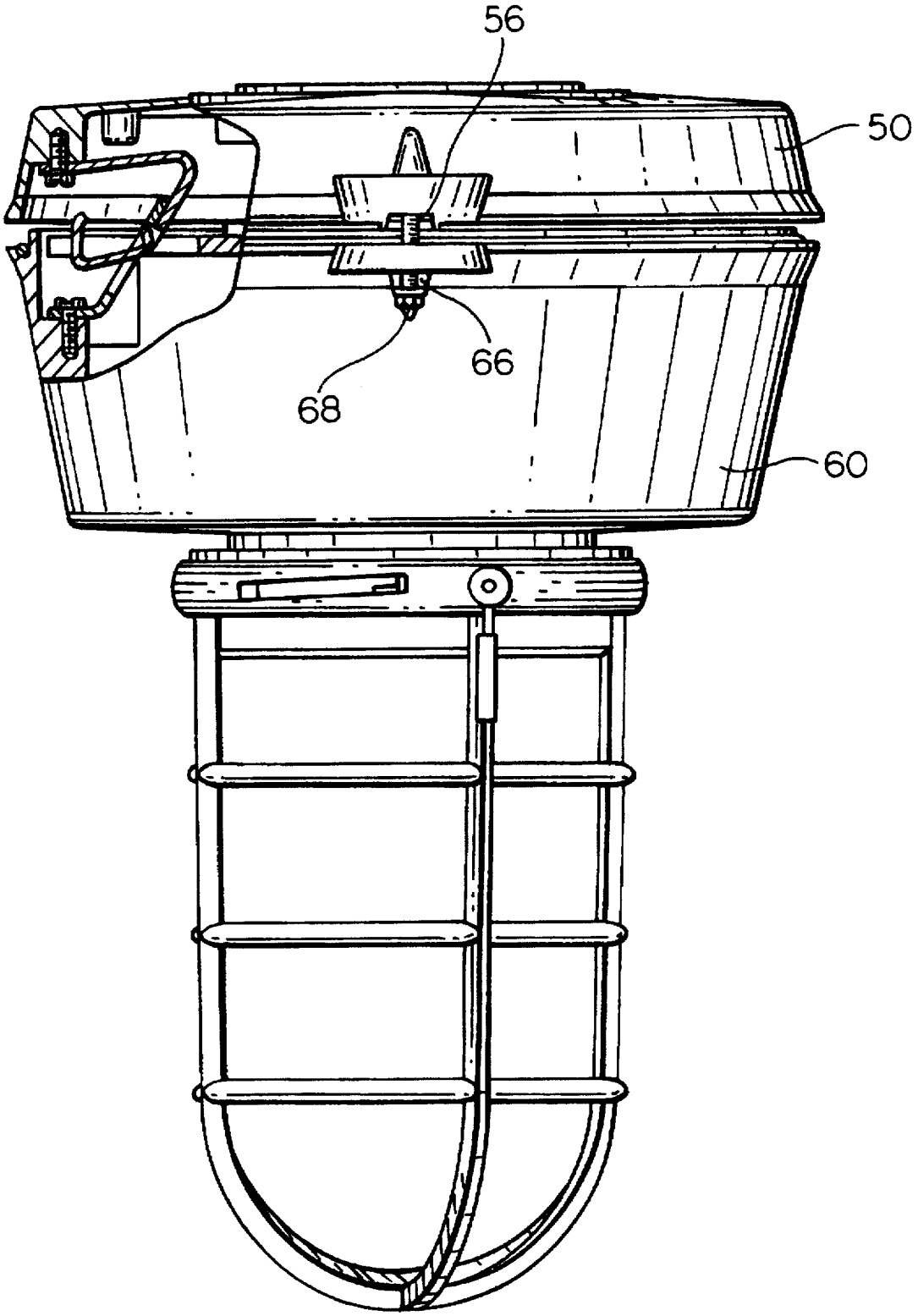
FIG. 3 illustrates a lighting fixture with a safety hook with a cutaway view of the safety hook in its second stage where the housing hangs close to and is aligned with the cover.
Figure 4:
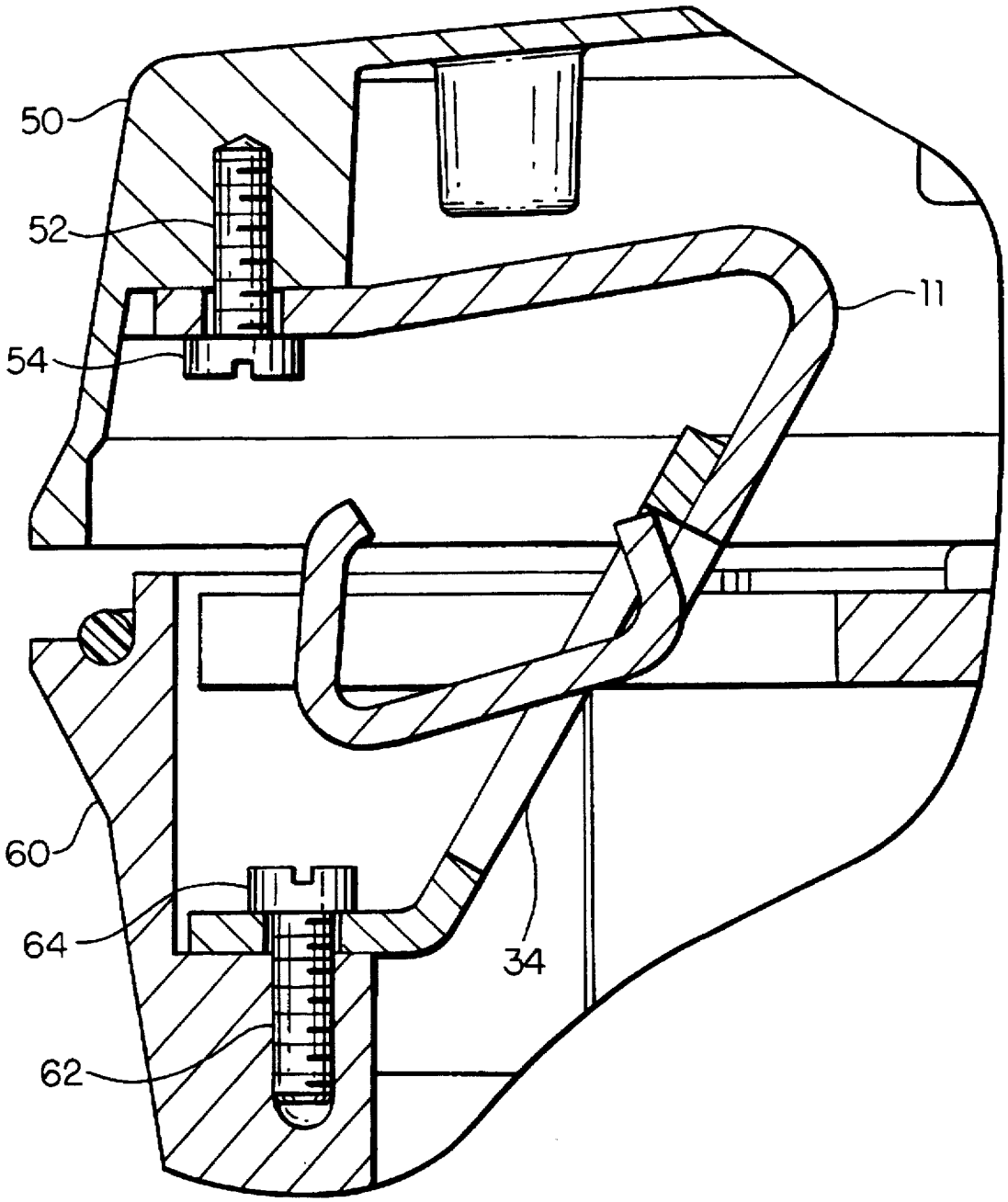
FIG. 4 is an enlarged view of the cutaway view in FIG. 2.

FIGS. 2–4 illustrate how the lighting fixture with a safety hook 10 is installed and operates. Hook 11 is installed in cover 50 so that hook 11 hangs down from cover 50. Cover 50 contains a threaded screw hole 52 which matches up with hole 32 in hook 11. A screw 54 can then be inserted through hole 32 and then tightened into threaded screw hole 52 so hook 11 is attached to cover 50. Once hook 11 is installed in cover 50, cover 50 is then mounted on a wall or other fixture hanging equipment.

Next, eye flange 34 is attached to housing 60. Hole 38 in flange 34 is matched up with threaded screw hole 62 in housing 60 so that flange 34 extends up and out of housing 60. Screw 64 is then inserted through hole 38 and tightened into threaded screw hole 62 so flange 34 is attached to housing 60.

Next, housing 60 is hooked onto cover 50 as illustrated in FIG. 2. Housing 60 is maneuvered so that slot 44 in eye flange 34 hooks over free end 14 of first hook element 12 of hook 11 in cover 50. Flange 34 is then guided down hook 11 until front edge 46 of elongated slot 44 engages and rests on bottom end 16 of hooked free end 15 of first hook element 12. Housing 60 can now freely and safely hang from first hook 12 in a relatively open position providing an installer or contractor with access to the interiors of the housing and cover to perform the necessary wiring of the lighting fixture.

After the wiring is complete, housing 60 is guided so eye flange 34 engages second hook element 22 of hook 11 in cover 50. Housing 60 is maneuvered so that elongated slot 44 of eye flange 34 is guided along first sloping portion 18. Then, elongated slot 44 is guided up second sloping portion 20 until front edge 46 of elongated slot 44 is positioned on and engages tab 24 of second hook element 22 as shown in FIGS. 3 and 4. When this step is complete, housing 60 and cover 50 will be in a substantially closed position where housing 60 is aligned with and cover 50. In addition, holes 66 on opposite sides of housing 60 will line up with threaded screw holes 56 on opposite sides of cover 50. The alignment of holes 56 and 66 allows an installer or contractor to insert screws 68 through holes 66 and up into threaded screw holes 56 without having to use his hands to hold up the housing while inserting and tightening screws 68.

In addition, when the lighting fixture needs to be serviced, the lighting fixture with a safety hook 10 will prevent housing 60 from dropping down. To service any components inside housing 60, screws 68 are removed. As screws 68 are loosened, housing 60 will slowly drop down until front edge 46 of elongated slot 44 engages tab 24 of second hook element 22. Thus, housing 60 will hang from cover 50 in a substantially closed position. Housing 60 can then be maneuvered down until front edge 46 of elongated slot 44 engages the bottom end 16 of hooked free end 15 or first hook element 12 so housing 60 hangs down in a relatively open position. If required, housing 60 can then be maneuvered so that eye flange 34 is guided up off of hook 11 so that housing 60 can then be easily taken down from cover 50. Thus, during servicing, housing 60 will never drop down onto the person performing the servicing of the fixture.

Thus, the aforementioned objectives are effectively attained. Although a single preferred embodiment of the invention has been disclosed and described in detail above, one should easily understand that the scope of this invention is in no sense limited by this disclosure but is determined by the appended claims.

We claim:

1. A safety assembly mechanism for use with a lighting fixture having a housing and a cover, said safety assembly mechanism comprising:

a hook mounted to said cover; and an eye flange mounted to said housing; said hook having a base member and an inclined member extending from said base member, said base member having hooked free end defining a first hook element and said inclined member having a tab spaced apart from said free end and extending from said inclined member toward said free end defining a second hook element; said eye flange having an elongated slot defined by front, rear and side edges, said slot front edge being engageable with said first hook element so as to hold said cover to said housing in a relatively open position providing wiring access to the interior of said housing and said slot front edge being engageable with said second hook element so as to hold said cover to said housing in a substantially closed position.

2. The safety assembly mechanism in accordance with claim 1 further comprising connecting means on both said housing and cover for securing said housing to said cover and wherein said second hook element and said eye flange are positioned so as to align said housing and cover connecting means.

3. The safety assembly mechanism in accordance with claim 2 wherein said connecting means comprises screw holes on both said housing and cover, at least one said housing and cover screw holes being threaded.

* * * * *